US009447973B2

(12) United States Patent
Clemen

(10) Patent No.: US 9,447,973 B2
(45) Date of Patent: Sep. 20, 2016

(54) COMBUSTION CHAMBER OF A GAS TURBINE

(71) Applicant: Rolls-Royce Deutschland Ltd & Co KG, Blankenfelde-Mahlow (DE)

(72) Inventor: Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 14/641,797

(22) Filed: Mar. 9, 2015

(65) Prior Publication Data

US 2015/0260405 A1 Sep. 17, 2015

(30) Foreign Application Priority Data

Mar. 11, 2014 (DE) ..... 10 2014 204 466

(51) Int. Cl.

| | |
|---|---|
| ***F02C 1/00*** | (2006.01) |
| ***F23R 3/02*** | (2006.01) |
| ***F23R 3/00*** | (2006.01) |
| ***F23R 3/60*** | (2006.01) |

(52) U.S. Cl.

CPC ..... *F23R 3/02* (2013.01); *F23R 3/002* (2013.01); *F23R 3/60* (2013.01); *F23R 2900/00017* (2013.01)

(58) Field of Classification Search

CPC ..... F23R 3/002; F23R 3/60; F02C 7/20
See application file for complete search history.

(56) References Cited

U.S. PATENT DOCUMENTS

| | | | | |
|---|---|---|---|---|
| 3,031,844 | A * | 5/1962 | Tomolonius | 60/752 |
| 4,628,694 | A * | 12/1986 | Kelm | B21D 35/00 60/752 |
| 4,686,823 | A | 8/1987 | Coburn et al. | |
| 5,291,732 | A * | 3/1994 | Halila | F23R 3/60 60/752 |
| 5,353,587 | A * | 10/1994 | Halila | 60/39.37 |
| 6,145,319 | A | 11/2000 | Burns et al. | |
| 6,397,603 | B1 * | 6/2002 | Edmondson et al. | 60/753 |
| 6,401,447 | B1 | 6/2002 | Rice et al. | |
| 6,513,330 | B1 | 2/2003 | Rice et al. | |
| 7,059,133 | B2 | 6/2006 | Gerendas | |

(Continued)

FOREIGN PATENT DOCUMENTS

| | | |
|---|---|---|
| DE | 10214570 | 1/2004 |
| EP | 0927992 | 7/1999 |

(Continued)

OTHER PUBLICATIONS

European Search Report dated Aug. 21, 2015 for related European Application No. 15158426.5.

(Continued)

*Primary Examiner* — Gerald L Sung
(74) *Attorney, Agent, or Firm* — Timothy J. Klima; Shuttleworth & Ingersoll, PLC

(57) ABSTRACT

A combustion chamber of a gas turbine includes an external combustion chamber wall and at least one shingle that is mounted at the same, as well as a base plate and a combustion chamber head, characterized in that the shingle extends over the entire length of the combustion chamber and is held at its frontal end area, as it appears with respect to the flow direction of the combustion chamber, inside a groove of the base plate, and at its back end area inside a groove of the external combustion chamber wall.

12 Claims, 3 Drawing Sheets

(56) References Cited

U.S. PATENT DOCUMENTS

| | | | | |
|---|---|---|---|---|
| 2005/0086945 | A1* | 4/2005 | Tiemann | F23M 5/04 60/800 |
| 2008/0230997 | A1* | 9/2008 | Boston et al. | 277/355 |
| 2009/0090110 | A1 | 4/2009 | Pardington et al. | |

FOREIGN PATENT DOCUMENTS

| | | | |
|---|---|---|---|
| EP | 1491823 | A1 | 12/2004 |
| EP | 2604926 | A1 | 6/2013 |
| GB | 2263733 | A | 8/1993 |
| GB | 2432902 | | 6/2007 |
| WO | 2004109187 | | 12/2004 |

OTHER PUBLICATIONS

German Search Report dated Mar. 28, 2014 from counterpart App No. 10 2014 204 466.9.

* cited by examiner

State of the art

COMBUSTION CHAMBER OF A GAS TURBINE

CROSS-REFERENCE TO RELATED APPLICATION

This application claims priority to German Patent Application No. 10 2014 204 466.9 filed on Mar. 11, 2014, the entirety of which is incorporated by reference herein.

BACKGROUND

The invention relates to a combustion chamber of a gas turbine, comprising an external combustion chamber wall and at least one tile that is mounted at the same, as well as a base plate.

It is known in the state of the art to attach combustion chamber tiles to a support structure of the combustion chamber's external wall, which is also called a liner. On the side that is facing towards the combustion chamber, the combustion chamber tiles have a large number of effusion cooling holes. These effusion cooling holes serve for cooling the tile to counteract the high temperatures inside the combustion chamber. Further, a combustion chamber tile has at least one mixing air hole through which air from the space externally surrounding the combustion chamber (annular channel/annulus) is guided inside the combustion chamber so as to mix with the combustion phase and to lean the combustion. What is particularly achieved in this manner is a reduction of the NOx formation inside the combustion chamber. In addition to cooling through the effusion cooling holes, the tiles are often provided with a ceramic coating that serves as an insulating layer against the high temperatures inside the combustion chamber.

In the solutions known from the state of the art, the attachment of a combustion chamber tile at the exterior wall of the combustion chamber is carried out by means of setscrews. These represent integral parts of the tiles which are mostly formed as cast parts, and they are usually threaded. The setscrews are guided through a hole in the exterior wall of the combustion chamber and, starting from the outside, are fixated at the exterior wall of the combustion chamber my means of a nut.

Such configurations are already known from U.S. Pat. No. 6,145,319 A, EP 0 927 992 A2 or DE 102 14 570 A1, for example.

It has turned out to be a disadvantage of the known solutions that the material of the bolts creeps due to the high thermal loads acting on the bolts. Because of the creep of the material, the prestress of the bolt is decreased through the nut. This results in a loosening of the bolts, which in turn may also lead to a loosening of the tiles.

Another disadvantage is the fact that with the tiles usually being formed as cast constructions according to the state of the art, it is not possible or possible only to a limited extent to manufacture them by means of an alternative manufacturing method, namely by means of additive manufacturing. Such additive manufacturing methods may be selective laser sintering, direct laser depositioning or electron beam deposition welding, for example. The reason for the limited manufacturability of the already known constructions particularly lies in the fact that a cost-intensive horizontal manufacturing has to be chosen. Alternatively, an elaborate substructure for supporting the setscrew is necessary. Such substructure are material-intensive and protract the manufacturing process, and they also have to be removed from the tile after the manufacture. All that is cost-intensive, as well.

SUMMARY

The invention is based on the objective to create a combustion chamber of a gas turbine in which the disadvantages of the state of the art are avoided and a safe-to-operate construction is facilitated while also providing for an easy assembly as well as an easy, cost-effective manufacturing process, particularly by means of additive manufacturing methods.

According to the invention, the objective is solved through the combination of features described herein, while further advantageous embodiments of the invention are also described herein.

Thus, it is provided according to the invention that the tile extends across the entire length of the combustion chamber and is mounted at its front as well as its back end inside one groove, respectively. The groove at its front end is formed at the base plate of the combustion chamber, while the groove at the back end is provided at the external combustion chamber wall.

Through the solution according to the invention it thus becomes possible to fully dispense with the threaded bolt. Instead, the tile is mounted only at its front and its back end area as a whole structural component. In this way, the tile may be manufactured in an easy and cost-effective manner.

By dispensing with the threaded bolt it becomes possible to optimize the thermal loads acting on the tile, as there are no longer any material accumulations as they occur in the area of the threaded bolt known in the state of the art.

The combustion chamber according to the invention can be easily manufactured by inserting the tile into the groove of the exterior combustion chamber wall with its back end area. Subsequently, the exterior combustion chamber wall is mounted at the base plate together with the tile by inserting the front end area of the tile into the groove of the base plate. After that, the exterior combustion chamber wall is welded together with the base plate.

According to the invention, it is possible to design the tile extending over the entire length of the combustion chamber in any desired way. In particular, it is possible to arrange multiple tiles next to each other in the circumferential direction. Thanks to this, an easy construction of the combustion chamber according to the invention is possible, which can be realized in a cost-effective manner. What is contributing to this is the fact that the tile according to the invention can be manufactured in a cost-effective manner by means of additive methods using vertical manufacturing.

Thus, according to the invention the tile has one spring at its front and its back end, respectively, with the spring being inserted into the corresponding groove. The spring as well as the groove can extend over the entire circumference or they can be formed in a segmented manner.

BRIEF DESCRIPTION OF THE DRAWINGS

In the following, the invention is described by referring to exemplary embodiments in connection with the drawing. Herein.

DETAILED DESCRIPTION

Figure 1:
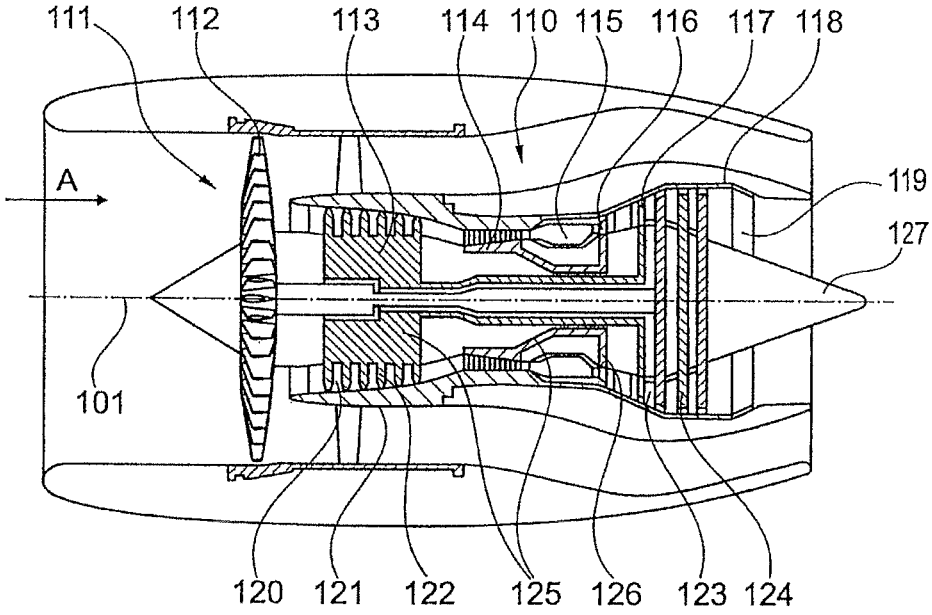
FIG. 1 shows a schematic representation of a gas turbine engine according to the present invention.

The gas turbine engine 110 according to FIG. 1 represents a general example of a turbomachine in which the invention may be used. The engine 110 is embodied in a conventional manner and comprises, arranged in succession in the flow direction, an air inlet 111, a fan 112 that is circulating inside a housing, a medium-pressure compressor 113, a high-pressure compressor 114, a combustion chamber 115, a high-pressure turbine 116, a medium-pressure turbine 117 and a low-pressure turbine 118 as well as an exhaust nozzle 119, that are all arranged around a central engine axis 101.

The medium-pressure compressor 113 and the high-pressure compressor 114 respectively comprise multiple stages, each of which has an array of fixedly attached, stationary guide blades 120 extending in the circumferential direction, which are generally referred to as stator blades and protrude radially inwards from the engine cowling 121 through the compressors 113, 114 into a ring-shaped flow channel. The compressors further have an array of compressor rotor blades 122 that protrude radially outwards from a rotatable drum or disc 125 coupled with hubs 126 of the high-pressure turbine 116 or the medium-pressure turbine 117.

The turbine sections 116, 117, 118 have similar stages, comprising an array of fixedly attached guide blades 123 that protrude radially inward from the housing 121 through the turbines 116, 117, 118 into the ring-shaped flow channel, and a subsequent array of turbine blades 124 that protrude outward from a rotatable hub 126. During operation, the compressor drum or the compressor disc 125 and the blades 122 arranged thereon as well as the turbine rotor hub 126 and the turbine blades 124 arranged thereon rotate around the central engine axis 101.

Figure 2:
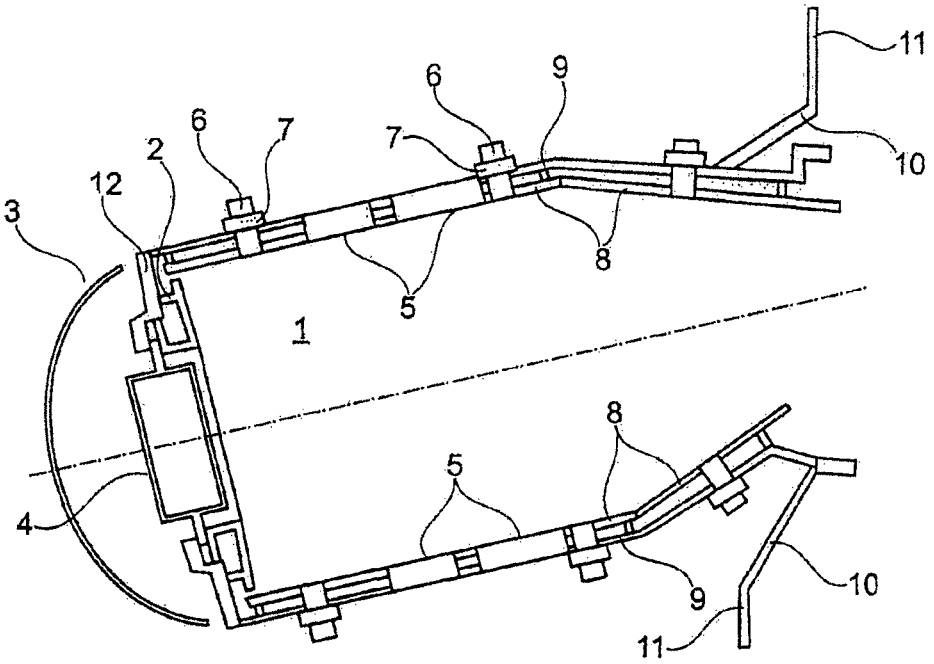
FIG. 2 shows a simplified lateral section view of a combustion chamber according to the state of the art.

FIG. 2 shows a simplified enlarged representation of a combustion chamber 1 as it is known in the state of the art. It comprises a heat shield 2, a combustion chamber head 3 and a burner seal 4. Further, an exterior combustion chamber wall 9 is provided in which dilution air holes 5 are formed. With view to clarity, impingement cooling holes and effusion holes have been omitted in the rendering. The combustion chamber wall 9 is mounted by means of combustion chamber suspensions 10 and combustion chamber flanges 11, as is known in the state of the art.

In the interior of the combustion chamber wall 9, tiles 8 are arranged that are integrally provided with bolts 6 and are secured by means of nuts 7 which reach through holes in the combustion chamber wall 9. At its front end area, the combustion chamber wall 9 is connected to the base plate 12, usually by welding.

Figure 3:
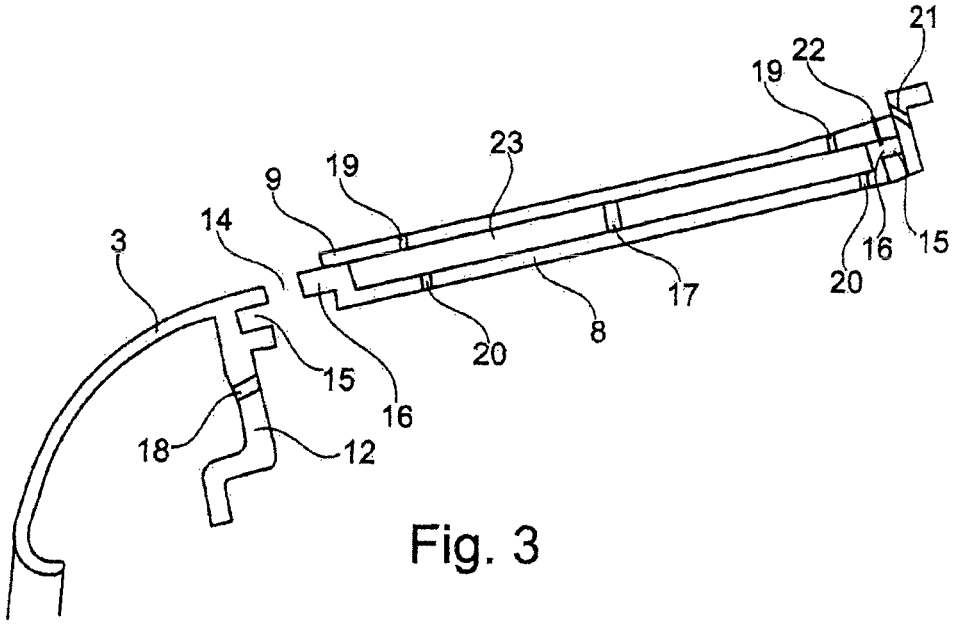
FIG. 3 shows a partial lateral view of an exemplary embodiment of a combustion chamber according to the invention in an unfinished state.
Figure 4:
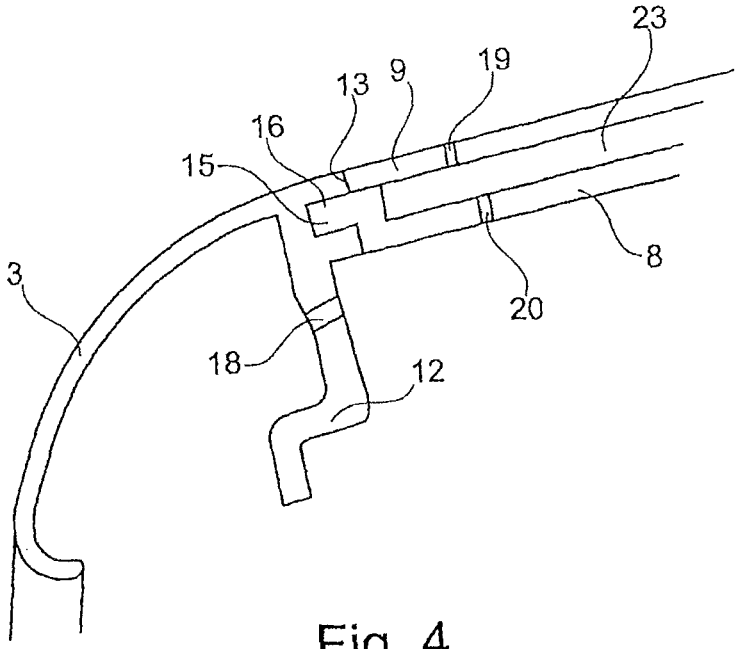
FIG. 4 shows a detailed view, analogous to FIG. 3, in the finished state.

FIGS. 3 and 4 show the embodiment of the combustion chamber according to the invention. Here, like parts are identified by like reference numbers.

As becomes clear from FIGS. 3 and 4, the base plate 12 that is connected to combustion chamber head 3 has a groove 15 at its circumference. A spring 16, which is formed at the front end of the tile 8, can be inserted into the groove 15. The tile 8 extends over the entire length of the combustion chamber and also has a spring 16 at its back end. That, too, can be inserted into a groove 15 that is formed at the back end area of the combustion chamber wall 9.

For support, support webs 17 are provided to ensure a correct distance of the tile 8 to the combustion chamber wall 9 so as to create a cooling air space 23. Cooling air is guided into that space through impingement cooling holes 19. Through effusion holes 20, the cooling air flows through the tile 8 so that it is cooled.

FIG. 3 shows a state in which the tile 8 is inserted into the groove of the combustion chamber wall 9 by means of its back spring 16. A temporary securing pin 22 can serve for securing. Then, the combustion chamber wall 9 is slid onto the base plate 12 together with the tile 8. Afterwards, the combustion chamber wall 9 can be welded together with the combustion chamber head 3. This results in the finished state as it is shown in FIG. 4. The reference sign 13 shows a welded seam 13 between the combustion chamber head 3 and the combustion chamber wall 9. The welded seam 13 is formed at a weld surface that is shown in FIG. 3.

Figure 5:
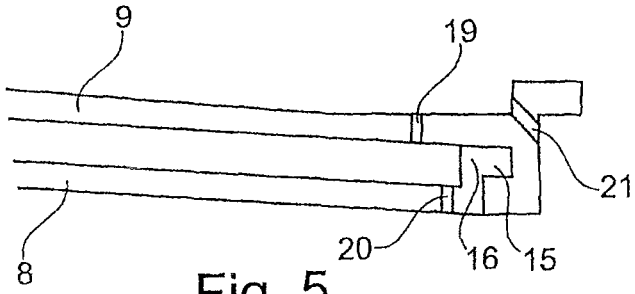
FIGS. 5 and 6 show detailed views of the back end areas and mountings of the tile in different embodiment variants.
Figure 6:
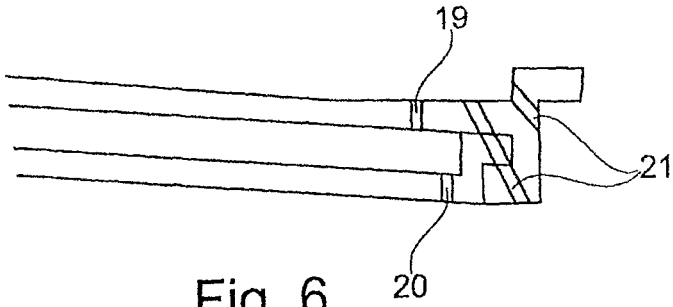

FIGS. 5 and 6 show the back part of the tile 8. As has been mentioned, it is inserted into the groove 15 of the combustion chamber wall 9 by means of its spring 16. Additional cooling holes 21 may be provided for cooling this area.

The invention claimed is:

1. A combustion chamber of a gas turbine comprising:

an external combustion chamber wall including a rear end area with respect to a flow direction of the combustion chamber, the rear end area of the external combustion chamber including an axially extending groove;

at least one shingle mounted to the external combustion chamber wall;

a base plate including an axially extending groove;

a combustion chamber head, wherein the at least one shingle extends over an entire length of the combustion chamber, the at least one shingle including a front end area and a rear end area with respect to the flow direction of the combustion chamber, the front end area of the at least one shingle positioned within the groove of the base plate to engage and be supported by the groove of the base plate to connect the at least one shingle to the base plate, the rear end area of the at least one shingle positioned within the groove of the external combustion chamber wall to engage and be supported by the groove of the external combustion chamber wall;

wherein at least a portion of the front end area of the at least one shingle is a spring, and the spring is positioned within the groove of the base plate to engage and be supported by the groove of the base plate to connect the at least one shingle to the base plate.

2. The combustion chamber according to claim 1, wherein a front end area of the external combustion chamber wall is welded together with the base plate.

3. The combustion chamber according to claim 1, wherein at least one of the grooves is formed as a circumferential groove.

4. The combustion chamber according to claim 1, wherein at least one of the grooves is formed as a segmented groove.

5. The combustion chamber according to claim 1, and further comprising cooling holes formed in an area of at least one of the grooves.

6. The combustion chamber according to claim 1, wherein the at least one shingle is formed as a segmented part at a circumference of the combustion chamber.

7. The combustion chamber according to claim 6, wherein the at least one shingle includes a plurality of shingles provided at the circumference of the combustion chamber.

8. The combustion chamber according to claim 1, wherein the spring is formed as at least one chosen from a circumferential ring and in a segmented manner.

9. A combustion chamber of a gas turbine comprising:

an external combustion chamber wall including a rear end area with respect to a flow direction of the combustion chamber, the rear end area of the external combustion chamber including an axially extending groove;

at least one shingle mounted to the external combustion chamber wall;

a base plate including an axially extending groove;

a combustion chamber head, wherein the at least one shingle extends over an entire length of the combustion chamber, the at least one shingle including a front end area and a rear end area with respect to the flow direction of the combustion chamber, the front end area of the at least one shingle positioned within the groove of the base plate to engage and be supported by the groove of the base plate to connect the at least one shingle to the base plate, the rear end area of the at least one shingle positioned within the groove of the external combustion chamber wall to engage and be supported by the groove of the external combustion chamber wall;

wherein at least a portion of the rear end area of the at least one shingle is a spring, and the spring is positioned within the groove of the external combustion chamber wall to engage and be supported by the groove of the external combustion chamber wall.

10. The combustion chamber according to claim 9, wherein the spring is formed as at least one chosen from a circumferential ring and in a segmented manner.

11. The combustion chamber according to claim 1, wherein at least a portion of the rear end area of the at least one shingle is a second spring, and the second spring is positioned within the groove of the external combustion chamber wall to engage and be supported by the groove of the external combustion chamber wall.

12. The combustion chamber according to claim 11, wherein the second spring is formed as at least one chosen from a circumferential ring and in a segmented manner.

* * * * *